US005220770A

United States Patent [19]

Szewczyk et al.

[11] Patent Number: 5,220,770

[45] Date of Patent: Jun. 22, 1993

[54] SELECTIVE OUTER ENVELOPE INSERTING SYSTEM

[75] Inventors: Richard M. Szewczyk, Lincoln; Lee E. Standefer, Malcolm, both of Nebr.

[73] Assignee: R. R. Donnelley & Sons Company, Chicago, Ill.

[21] Appl. No.: 846,488

[22] Filed: Feb. 27, 1992

[51] Int. Cl.[5] ..... B65B 57/02; B65B 57/10

[52] U.S. Cl. ..... 53/493; 53/55; 53/168; 53/284.3

[58] Field of Search ..... 53/495, 493, 55, 58, 53/77, 74, 284.3, 569, 206, 460, 237, 250, 168, 447, 443

[56] References Cited

U.S. PATENT DOCUMENTS

| | | | |
|---|---|---|---|
| Re. 26,615 | 6/1969 | Willbrandt | 53/460 |
| 4,571,925 | 2/1986 | Adams | 53/284.3 X |
| 4,585,220 | 4/1986 | Zemke et al. | 53/284.3 X |
| 4,733,856 | 3/1988 | Gunther, Jr. | 53/284.3 X |
| 4,739,606 | 4/1988 | Cantile | 53/493 |
| 4,821,493 | 4/1989 | Pintsov | 53/168 X |
| 5,067,305 | 11/1991 | Baker et al. | 53/55 X |

*Primary Examiner*—James F. Coan
*Attorney, Agent, or Firm*—Arnold, White & Durkee

[57] ABSTRACT

A selective outer envelope inserting system includes a multiple station inserter and a multiple outer envelope collator mechanically coupled to the multiple station inserter. The multiple station inserter includes a plurality of hoppers containing inserts. One of the hoppers contains a control piece insert. The control piece insert includes a machine readable code such as a bar code that is scanned by a scanner. The scanner is interfaced with a control such as a microprocessor that controls the various hoppers to select a variety of combinations of inserts thereby determining the contents within each envelope. The multiple outer envelope collator includes a plurality of envelope hoppers, and the envelopes in each hopper differ from the envelopes in the other hoppers. The control is interfaced with the collator to control the operation of each individual envelope hopper. Through the code on the control piece, a specific envelope may be selected for each combination of inserts.

21 Claims, 3 Drawing Sheets

SELECTIVE OUTER ENVELOPE INSERTING SYSTEM

BACKGROUND OF THE INVENTION

A. Field of the Invention

The present invention relates generally to a new and improved outer envelope inserting system, and more specifically, to a new and improved system for selecting various insert combinations and inserting these combinations into one of several different outside envelopes.

B. Description of the Prior Art

Direct mail companies and similar organizations have need for high volume mailers and envelope stuffers in the form of high speed paper management systems. These systems typically have a plurality of hoppers each containing a stack of inserts. The inserts in each hopper differ from the inserts in other hoppers. A control insert is usually located in the first hopper. The control insert includes a code which corresponds to a specific job.

These systems typically have a scanner that reads the code on the control piece. The scanner is coupled to a computer that controls the operation of a plurality of dispensers. A dispenser is associated with each insert hopper. The computer controls the operation of the dispensers to select the combination of inserts for each envelope. Once the inserts have been assembled, the stack of selected inserts are inserted into an envelope. For example, it may be desired to mail a specific combination of inserts to families with new babies. The computer controls the combination of inserts such that one combination of inserts will be inserted into an envelope that is mailed to a family that has a baby girl, whereas a different combination of inserts will be inserted into an envelope that is mailed to a family that has a baby boy. Although the combination of inserts will be different for each family, the envelopes are identical. These prior art systems are incapable of providing different envelopes for different combinations of inserts.

Examples of inserting systems can be found in U.S. Pat. Nos. 4,962,623; 4,544,146; 4,585,220; 4,733,856; 4,517,650; 4,821,493; 4,649,691; and 4,739,606. Each of the systems disclosed in these patents suffer from the disadvantage that regardless of the different combinations of inserts being mailed, all the combinations of inserts are mailed in identical envelopes. It would be advantageous for marketing purposes if the envelopes could vary according to the combination of inserts for each envelope.

SUMMARY OF THE INVENTION

Briefly, the present invention is directed to a new and improved selective outer envelope inserting system. The system of the present invention includes a multiple station inserter capable of inserting a variety of combinations of inserts into envelopes. This system, however, also includes a multiple station envelope collator that is mechanically connected to the multiple station inserter and allows the selection of different envelopes in accordance with the specific combination of inserts to be inserted in the envelopes. For example, if the system is assembling inserts to be sent to families with newborn babies, the combination of inserts intended to be mailed to a family having a baby boy can be put in one envelope and the combination of inserts to be sent to a family having a baby girl can be sent in a different envelope. More specifically, the envelope for a family having a boy can be blue, whereas the envelope sent to the family having a baby girl can be pink.

The multiple station inserter includes a plurality of insert hoppers, one of which is a control piece hopper. As each control piece is dispensed from the control piece hopper, a code on the control piece is scanned by a scanner. The scanner interfaces with a microprocessor or computer which controls the actuation of the insert hoppers. In accordance with the code, a different combination of hoppers is activated as the control piece moves through the multiple station inserter. Consequently, at the end of the multiple station inserter, a specific combination of inserts in accordance with the code have been accumulated.

The multiple outer envelope collator also interfaces with the microprocessor and is mechanically linked to the multiple station inserter. The multiple outer envelope collator includes a plurality of envelope hoppers, and each hopper includes an envelope that differs from the envelopes in the other hoppers. In accordance with the code on each control piece, the multiple outer envelope collator dispenses a different envelope depending on the specific combination of inserts. Thus, different combinations of inserts are inserted into different outer envelopes.

BRIEF DESCRIPTION OF THE DRAWINGS

The above and other objects and advantages and novel features of the present invention will become apparent from the following detailed description of a preferred embodiment of the invention illustrated in the accompanying drawings wherein.

This invention is susceptible to various modifications and alternative forms, and it should be understood that it is not intended to limit the invention to any particular form disclosed. On the contrary, the intention is to cover all modifications, equivalents, and alternatives falling within the spirit and scope of the invention as defined by the appended claims.

DESCRIPTION OF THE PREFERRED EMBODIMENT

Figure 1:
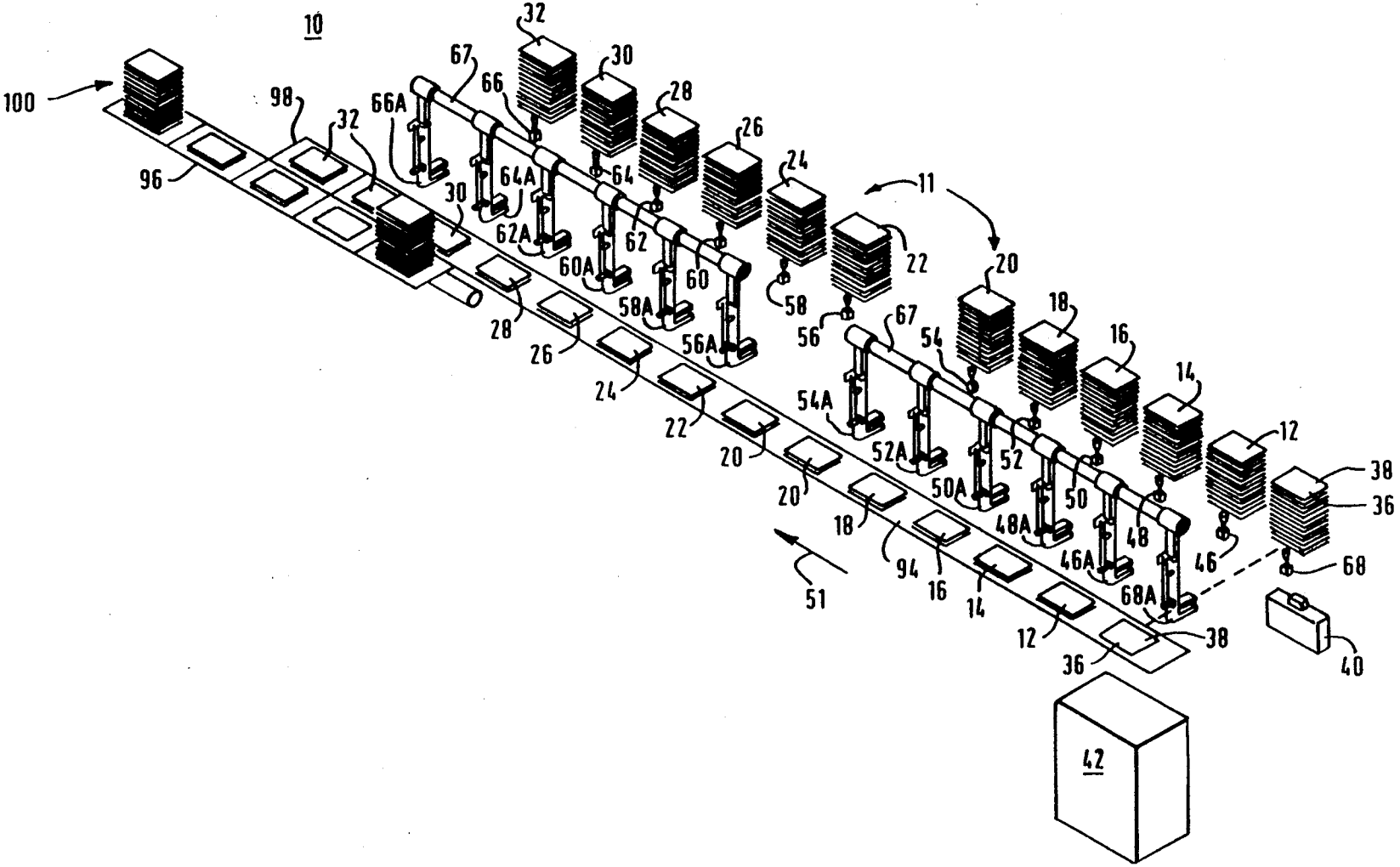
Fig. 1 PRIOR ART
FIG. 1 is a schematic illustration of a prior art multiple station inserter.

Referring now to the drawings and initially to FIG. 1, there is illustrated a prior art twelve station inserter generally designated by the reference numeral 10. The twelve station inserter 10 has the capability of inserting various combinations of inserts, such as inserts 12, 14, 16, 18, 20, 22, 24, 26, 28, 30, and 32, into a single outer envelope 34. One example of a twelve station inserter 10 is the Selectronic inserting system provided by Metromail. The inserts 12–32 are each stacked into individual hoppers, the hoppers are generally designated by the reference numeral 11. Similarly, the outer envelopes 34 are stacked in an envelope hopper 35.

The specific combination of inserts 12–32 that are inserted into an envelope is determined by a predefined code 36 that is printed on a control piece or order form 38. The code 36 may be any bar code such as, for example, an interleaved code in a miniature form. The order forms 38 are stacked in a control piece or order form hopper, and each order form 38 can include a different bar code 36. For example, each bar code 36 can correspond to the address of a recipient of the particular envelope 34 and can identify the combination of inserts 12–32 that corresponds in some way to the recipient and will be selected for insertion into the envelope 34.

The twelve station inserter system 10 includes a bar code reader or scanner 40 that is interfaced with a computer or microprocessor 42. Each of the hoppers for the inserts 12–32 includes a suction cup and solenoid 46–66 that separates an insert from the other inserts in each hopper 11. The solenoids are controlled by the computer 42 to separate inserts in accordance with each bar code 36. A gripper arm 46A–66A is adjacent each suction cup and solenoid 46–66. The gripper arms 46A–66A are mounted on a common shaft 67 and pivot together to grab separated inserts 12–32 and place them on a raceway 94. In addition, a suction cup and solenoid 68 are aligned with the hopper for the control pieces 38, and a gripper arm 68A is aligned with the suction cup and solenoid 68.

During operation of the twelve station inserter system 12, a control piece 38 is dispensed from the control piece hopper by the suction cup and solenoid 68 and the gripper arm 68A. The bar code reader 40 reads the code 36 printed on the control piece 38 and transmits this information to the computer 42. The computer 42 then matches that information to a data base maintained in the computer and at each subsequent hopper 12–32, the computer 42 checks to determine if an insert 12–32 is required from that hopper. The computer 42 activates only those suction cups and solenoids 46–66 for which an insert 12–32 is to be pulled from its respective hopper. As each insert is pulled, it is placed on a belt or raceway 94 or similar conveying device. The computer 42 also interfaces with the hopper 35 for the envelopes 34. Once the combination of inserts 12–32 has been assembled, this stack of inserts reaches the end of the first raceway 94 adjacent to an insert plate 98.

The insert plate 98 has mechanical fingers that insert the stack of inserts 12–32 into an awaiting envelope 34. The envelopes 34 are dispensed onto a second raceway 96 moving in the same direction as the direction of inserts 12–32 along the first raceway 94. Once the inserts 12–32 have been stuffed or inserted into an envelope 34, the envelope 34 continues its movement down the second raceway 96 and is stacked at the position generally designated by the reference numeral 100. Periodically, the stack of envelopes with the inserts are removed from position 100 and mailed or handled in accordance with the continuing operation.

The twelve station inserter 10 of the prior art is fast and efficient, however, it lacks the capability of providing different outer envelopes 34 depending on the specific combination of inserts 12–32 to be inserted in the envelopes. For example, if a combination of inserts 12–32 is being mailed to families with newborn children, the same envelope 34 is mailed to all families regardless of whether the baby is a girl or boy.

Figure 2:
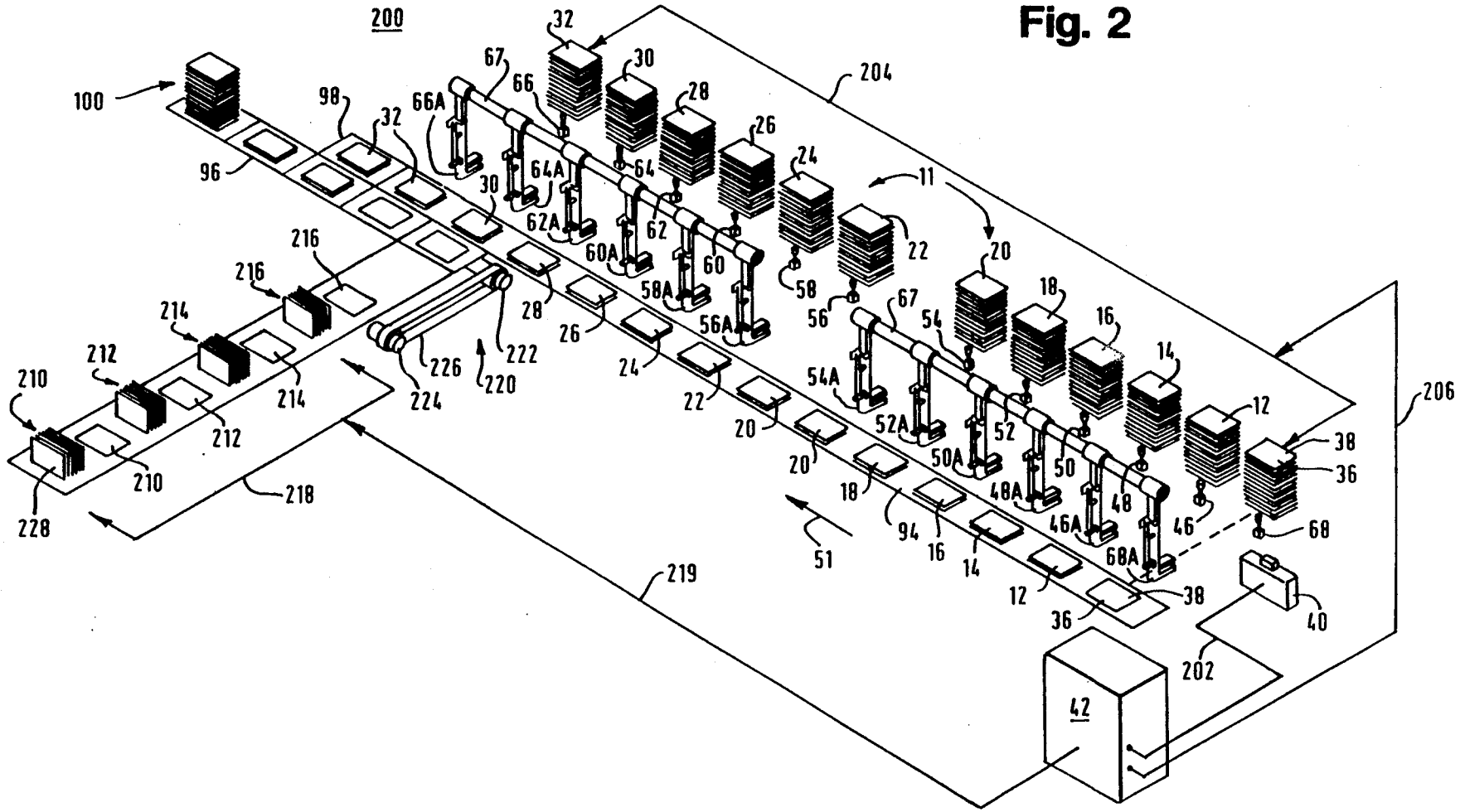
FIG. 2 is a schematic illustration of a multiple station inserter and multiple outer envelope collator constructed in accordance with the principles of the present invention.

The capability of inserting inserts into a selected outer envelope is provided by the inserter of the present invention generally designated by the reference numeral 200 and illustrated in FIG. 2. The inserter system 200 is a twelve station inserter similar to the inserter system 10 illustrated in FIG. 1. Those components of the inserter system 200 that are the same as the twelve station inserter system 10 are designated by the same reference numerals as appear in FIG. 1. In the system 200, the scanner or bar code reader 40 is interfaced with the computer 42 by a wire or cable 202. The computer 42 is interfaced with the system of suction cups and solenoids 46–68 generally designated by the reference numeral 204 by a cable 206.

The inserter system 200 differs from the twelve station inserter 10 in that the system 200 includes a multiple envelope collator 218. The envelope collator 218, in a preferred embodiment, includes four envelope hoppers 210, 212, 214 and 216, each containing a different envelope 210–216, respectively. The envelope collator 218 is mechanically coupled to the inserter 200 through a mechanical linkage generally designated by the reference numeral 220. The linkage 220 includes a pair of pulleys 222 and 224 coupled by a timing belt 226. This linkage allows the correct envelope 210, 212, 214 or 216 to be at the insert plate 98 at the same time as the combination of inserts intended for that envelope reaches the insert plate 98.

The inserter system 200 functions substantially the same as the inserter portion of the system 10. That is, as a bar code 36 on an order form 38 is read by the scanner 40, this information is communicated to the computer 42 which actuates selected suction cups and solenoids 46–66 and the gripper arms 46A–66A to dispense a combination of inserts 12–32. At the same time, the computer 42 interfaces with the envelope collator 218 by a cable 219 to select one of the envelopes from hoppers 210–216 into which the selected inserts 12–32 are to be inserted. Upon command from the computer 42, one of the hoppers for the envelopes 210, 212, 214 or 216 is actuated. The selected envelope from hopper 210, 212, 214 or 216 is placed on a third raceway 228 and is moved to the second raceway 96 under the control of the timing belt 226 and the mechanical linkage. For purposes of understanding, the envelopes in the envelope collator 210 are designated by the reference number of the envelope hopper from which the envelope is dispensed. As the combination of inserts reaches the insert plate 98, the insert plate 98 inserts the selected combination of inserts into the appropriate envelope 210, 212, 214 or 216. The envelope and inserts then move along the second raceway 96 to be stacked in the envelope hopper 100.

Consequently, the bar code 36 functions not only to select the desired combination of inserts 12–32, but also to select one of four envelopes 210, 212, 214, or 216 into which the selected combination of inserts is to be stuffed or inserted. For example, if different combinations of inserts 12–32 are to be sent to different families depending on the gender of their newborn children, the bar code 36 will indicate that a certain combination of inserts will be sent to a family with a newborn boy and the computer 42 will activate the envelope collator 218 to dispense an envelope which is identifiable with the family. For example, the envelope 216 may be blue and this envelope will be dispensed. The envelope 216 is moved by the third raceway 228 to a position adjacent to the envelope stuffer or inserter 98 at the same time that the stack or specific combination of inserts 12–32 intended for the envelope 216 reaches the insert plate 98. The combination of inserts for a baby boy are then inserted into the insert plate 98. The combination of inserts for a baby boy are then inserted into the envelope 216.

Similarly, if the combination of inserts 12–32 is to be sent to a family having a baby girl, the computer 42 will actuate the hopper containing envelopes that are pink in color. This may be envelope 214. The envelope 214 will reach the insert plate 98 at the same time as the intended inserts 12–32 and the inserts are inserted into the pink envelope 214.

The envelopes 210, 212, 214 and 216 preferably are of the same physical dimensions but may differ in appearance. For example, they may be of a different color or may include different printing on the outside of the envelope.

Figure 3:
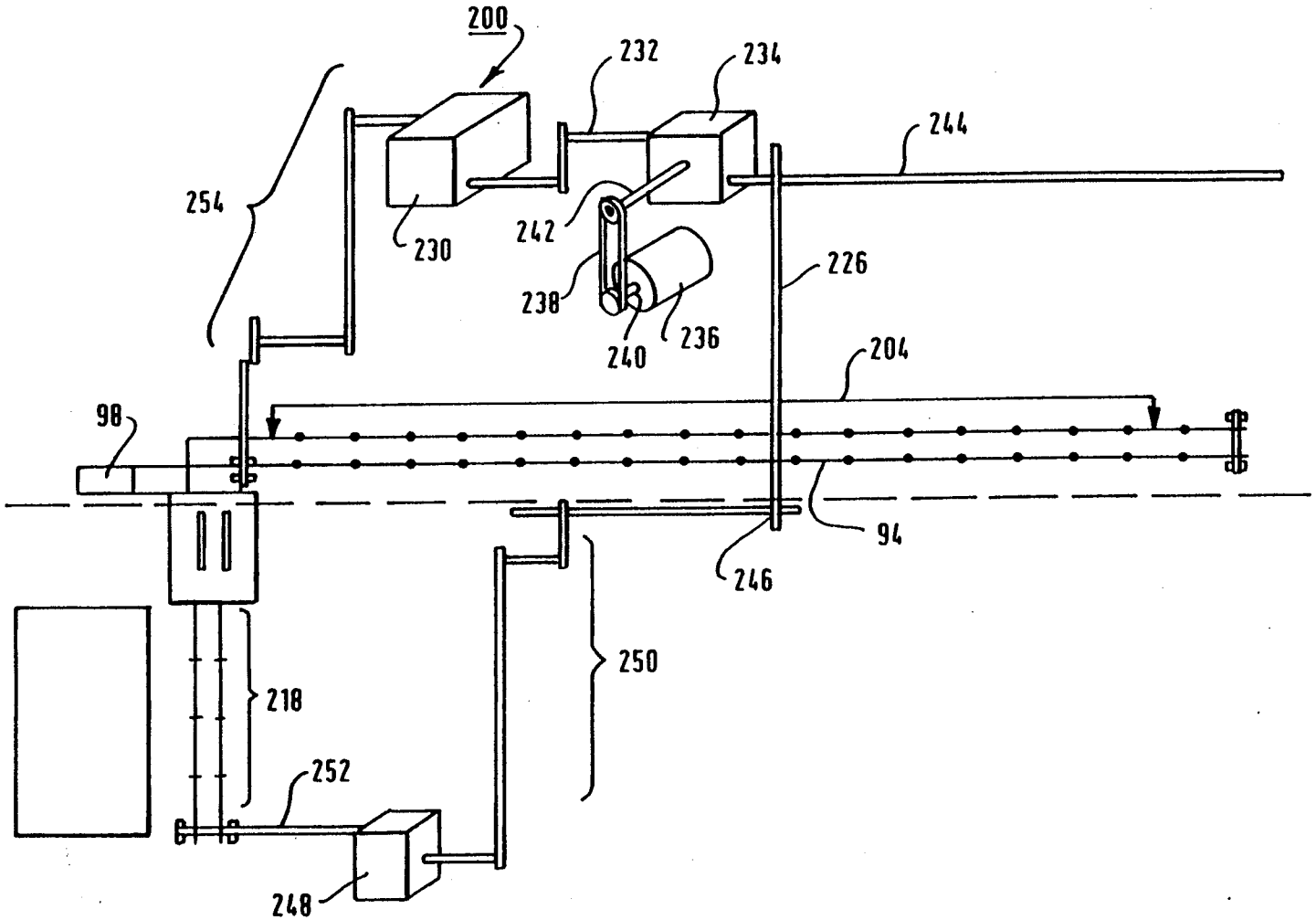
FIG. 3 is a schematic illustration of the different components of the multiple station inserter and multiple outer envelope collator illustrated in FIG. 2.

The mechanical interconnection of the inserter system 200 and the envelope collator 218 may be also understood by reference to FIG. 3. Illustrated in FIG. 3 are the selected insert hoppers 204 which contain the inserts 12–32. The first raceway 94 is also illustrated. The mechanical linkage linking the multiple station inserter 200 and the envelope collator 218 includes an index drive 230 that is connected by a linkage 232 to a reducer 234. The reducer 234 is connected to a motor 236 by a belt 238 that interconnects a shaft 240 of the motor to a shaft 242 of the reducer 234. The motor 236 provides the motive power for the inserter 200. The reducer 234 includes a main drive shaft 244 to which the timing belt 226 is connected. The timing belt 226 is interconnected to a timing pulley 246 which is connected to a collator drive 248 through a chain drive linkage 250. A shaft 252 of the collator drive 248 is connected to the envelope collator 218 thereby transmitting power to the third raceway 228. The insert plate 98 is interconnected with the index drive 230 by a chain drive linkage 254.

The inserter system 200 with the envelope collator 218 provides the ability to pull different envelopes 210–216 into a single mail stream without disturbing the sequence of the mail stream. Each envelope 210–216 can be different as to color or printed matter appearing on the outside and are dispensed based on information embedded in the bar code 36. The selection of the outer envelope from a number of different envelopes has not been previously available in the single envelope inserter system.

We claim:

1. A selective outer envelope inserting system, comprising:

a multiple station inserter;

said multiple station inserter including a plurality of insert hoppers, each said insert hopper including a plurality of inserts, one of said hoppers being a control piece hopper including control pieces, each control piece includes a code, each code corresponding to an envelope hopper and insert combination; a plurality of control pieces creating a mail stream;

means for scanning said code on each said control piece to distribute selected inserts into said mail stream;

control means interfaced with said scanning means for controlling said insert hoppers in accordance with said code on each said control piece; and a multiple outer envelope collator mechanically linked to said multiple station inserter;

said multiple outer envelope collator including a plurality of envelope hoppers;

said control means interfaced with said multiple outer envelope collator for controlling and selecting one of said plurality of said envelope hoppers in accordance with the code on each control piece, said control means allowing the selection of different ones of said plurality of envelope hoppers without interrupting said mail stream.

2. The selective outer envelope inserting system set forth in claim 1 wherein said code on each control piece is a machine readable bar code.

3. The selective outer envelope inserting system set forth in claim 1 wherein said scanning means is a bar code reader.

4. The selective outer envelope inserting system set forth in claim 1 wherein said control means is a microprocessor.

5. The selective outer envelope inserting system set forth in claim 1 wherein said multiple outer envelope collator is mechanically linked to said multiple station inserter by a timing belt.

6. The selective outer envelope inserting system set forth in claim 1 wherein envelopes in each of said envelope hoppers differs from envelopes in any other envelope hopper.

7. The selective outer envelope inserting system set forth in claim 1 wherein envelopes in each of said envelope hoppers are of the same dimensions as envelopes in any other hopper and are of a different design from envelopes in any other hopper.

8. In a multiple station inserter including a plurality of insert hoppers with at least a control piece hopper, each said insert hopper including a plurality of inserts, said control piece hopper including control pieces, each control piece including a code, a plurality of control pieces creating a mail stream, a scanner for scanning control pieces, and a controller interfaced with the scanner for controlling said insert hoppers to distribute selected inserts into said mail stream, the improvement comprising:

a multiple outer envelope collator coupled to said multiple station inserter to allow insertion of different combinations of inserts into one of a plurality of different envelopes, said multiple outer envelope collator including a plurality of envelope hoppers;

said controller interfaced with said multiple outer envelope collator for controlling said plurality of envelope hoppers and selecting one of said plurality of envelope hoppers in accordance with the code on each control piece, said controller allowing the selection of different ones of said plurality of envelope hoppers without interrupting said mail stream.

9. The improved multiple station inserter set forth in claim 8 wherein each envelope hopper includes envelopes that differ from envelopes in any of the other of said plurality of envelope hoppers.

10. The improved multiple station inserter set forth in claim 8 wherein envelopes in each of said plurality of envelope hoppers are of the same dimensions as and of a different design from the envelopes in the other envelope hoppers.

11. The improved multiple station inserter set forth in claim 8 wherein said plurality of envelope hoppers comprise four hoppers.

12. A selective outer envelope inserting system, comprising:

a multiple station inserter;

said multiple station inserter including a plurality of insert hoppers, one of said hoppers being a control piece hopper including control pieces, each control piece includes a code;

means for scanning said code on each said control piece;

control means interfaced with said scanning means for controlling said insert hoppers. in accordance with said code on each said control piece; and a multiple outer envelope collator mechanically linked to said multiple station inserter by a timing belt, said timing belt synchronizing said multiple station inserter and said multiple outer envelope collator;

said multiple outer envelope collator including a plurality of envelope hoppers;

said control means interfaced with said multiple outer envelope collator for controlling said envelope hoppers in accordance with the code on each control piece.

13. The selective outer envelope inserting system set forth in claim 12 wherein said code on each control piece is a machine readable bar code.

14. The selective outer envelope inserting system set forth in claim 12 wherein said scanning means is a bar code reader.

15. The selective outer envelope inserting system set forth in claim 12 wherein said control means is a microprocessor.

16. The selective outer envelope inserting system set forth in claim 12 wherein envelopes in each of said envelope hoppers differs from envelopes in any other envelope hopper.

17. The selective outer envelope inserting system set forth in claim 12 wherein envelopes in each of said envelope hoppers are of the same dimensions as envelopes in any other hopper and are of a different design from envelopes in any other hopper.

18. In a multiple station inserter including a plurality of insert hoppers with at least a control piece hopper, a scanner for scanning control pieces, and a controller interfaced with the scanner for controlling said insert hoppers, the improvement comprising:

a multiple outer envelope collator synchronously coupled to said multiple station inserter to allow insertion of different combinations of inserts into one of a plurality of different envelopes, said multiple outer envelope collator including a plurality of envelope hoppers;

said controller interfaced with said multiple outer envelope collator for controlling said plurality of envelope hoppers.

19. The improved multiple station inserter set forth in claim 18 wherein each envelope hopper includes envelopes that differ from envelopes in any of the other of said plurality of envelope hoppers.

20. The improved multiple station inserter set forth in claim 18 wherein envelopes in each of said plurality of envelope hoppers are of the same dimensions as and of a different design from the envelopes in the other envelope hoppers.

21. The improved multiple station inserter set forth in claim 18 wherein said plurality of envelope hoppers comprise four hoppers.

* * * * *